US006234087B1

(12) United States Patent
Brown

(10) Patent No.: US 6,234,087 B1
(45) Date of Patent: May 22, 2001

(54) MACHINE DISPENSED MODULAR PALLET

(75) Inventor: Henry F. Brown, Portage, WI (US)

(73) Assignee: Alltrista Corporation, Indianapolis, IN (US)

( * ) Notice: Subject to any disclaimer, the term of this patent is extended or adjusted under 35 U.S.C. 154(b) by 0 days.

(21) Appl. No.: 09/489,131

(22) Filed: Jan. 21, 2000

(51) Int. Cl.[7] ..... B65D 19/12
(52) U.S. Cl. ..... 108/56.1; 100/55.1
(58) Field of Search ..... 108/54.1, 55.1, 108/53.3, 56.1, 51.11, 57.25; 100/901, 902

(56) References Cited

U.S. PATENT DOCUMENTS

| | | | | |
|---|---|---|---|---|
| 3,650,224 | | 3/1972 | Petix et al. . | |
| 3,654,874 | | 4/1972 | Skinner . | |
| 3,857,342 | | 12/1974 | Johns . | |
| 4,062,301 | * | 12/1977 | Pitchford | 108/54.1 X |
| 4,095,769 | * | 6/1978 | Fengels | 108/54.1 X |
| 4,287,991 | | 9/1981 | Donnelly . | |
| 4,597,338 | | 7/1986 | Kreeger . | |
| 4,694,962 | | 9/1987 | Taub . | |
| 4,799,433 | | 1/1989 | Luft . | |
| 4,993,330 | | 2/1991 | Yen . | |
| 5,052,307 | * | 10/1991 | Morrison | 108/56.1 X |
| 5,094,175 | | 3/1992 | Christie . | |
| 5,105,746 | | 4/1992 | Reynolds . | |
| 5,231,934 | * | 8/1993 | Good | 108/54.1 |
| 5,267,516 | * | 12/1993 | Abrahamson et al. | 108/54.1 |
| 5,351,627 | | 10/1994 | Junaedi . | |
| 5,546,871 | * | 8/1996 | Chapman | 108/54.1 |
| 5,562,047 | | 10/1996 | Forney et al. . | |
| 5,579,686 | | 12/1996 | Pigott et al. . | |
| 5,579,700 | | 12/1996 | Nuechterlein et al. . | |
| 5,582,113 | | 12/1996 | Langenbeck . | |
| 5,606,921 | * | 3/1997 | Elder et al. | 108/53.3 |
| 5,651,463 | * | 7/1997 | Major et al. | 108/53.3 X |
| 5,676,067 | | 10/1997 | Breindel . | |
| 5,784,971 | | 7/1998 | Chang . | |
| 5,794,543 | | 8/1998 | John et al. . | |
| 5,809,905 | | 9/1998 | John et al. . | |
| 5,829,364 | | 11/1998 | Urbach . | |
| 5,860,369 | | 1/1999 | John et al. . | |
| 5,887,529 | | 3/1999 | John et al. . | |

* cited by examiner

*Primary Examiner*—Jose V. Chen
(74) *Attorney, Agent, or Firm*—Lathrop & Clark, LLP

(57) ABSTRACT

A modular pallet system has two or more pallets, each of which has four legs and which is capable of standing on its own as an independent unit. The pallets are formed to dimensions which are a fraction of conventional pallet sizes, such that one pallet alone serves as a quarter of a standard dimensioned pallet, while two pallets combined serve as a half of a standard dimensioned pallet. Each pallet has tabs and slots on the perimeter edges, with the result that two or more of the small pallets can be assembled into a standard size pallet in an interference fit without tools. The pallets may be produced as single sheet thermoformed or twin sheet thermoformed parts, or could be injection molded or structural foam molded. An adapter may be attached in a snap fit beneath four joined pallets to facilitate interaction between the combined pallets and conventional racks and conveyors, and to facilitate stacking.

11 Claims, 7 Drawing Sheets

MACHINE DISPENSED MODULAR PALLET

BACKGROUND OF THE INVENTION

The present invention relates to pallets in general, and to pallets intended to be delivered to points of retail sale in particular.

Many retail sales establishments receive smaller articles, such as boxes cans, and bottles mounted on pallets. Pallets used in combination with the forklift have produced substantial economies in the movement of goods by providing many different goods with a similar interface, allowing mechanization and unitization of goods.

In the New Economy, substantial reductions in the cost of replenishment of inventory have been achieved by large retailers by cooperating with suppliers to determine and even supply inventories necessary to meet fluctuating demands for goods. By pushing the responsibility for maintaining inventory back to the supplier of a good, and maintaining regional warehouses stocked by suppliers who are supplied with near realtime information on in-store purchases, the costs of the so-called "middle man" has been largely eliminated.

The pressure to reduce the cost of supplying goods continues to drive a search for improvements in distribution and retailing. One approach often employed by discount retailers is to stock and sell retail products directly off pallets, thus eliminating or reducing the cost of stocking goods to shelves. This technique of selling retail directly from pallets is being used on a selected basis by larger grocery stores and other mainline retailers.

Often when a retailer requires less than a full pallet load of goods, it is necessary to break down the full pallet into fractional pallet loads by unloading the larger pallet. This transfer is costly in time and manpower, and contributes to the cost of the goods.

What is needed is a pallet systems which facilitates this trend of reduced distribution cost and broadens the class of retailers who can take advantage of the new economies of distribution.

SUMMARY OF THE INVENTION

The modular pallet system of this invention has two or more pallets, each of which has four legs and which is capable of standing on its own as an independent unit. However, the pallets are formed to dimensions which are a fraction of conventional pallet sizes, such that one pallet alone serves as a quarter of a standard dimensioned pallet, while two pallets combined serve as a half of a standard dimensioned pallet. Each pallet has tabs and slots on the perimeter edges, with the result that two or more of the small pallets can be assembled into a standard size pallet. The pallets may be produced as single sheet thermoformed or twin sheet thermoformed parts, or could be injection molded or structural foam molded. The pallets are connected together in an interference fit and do not require any loose connectors or tools to assemble.

An adapter may be attached in a snap fit beneath four joined pallets to facilitate interaction between the combined pallets and conventional racks and conveyors, and to facilitate stacking.

It is an object of the present invention to provide a pallet which may be combined with other pallets to form a larger compound pallet which combines into a single unit load.

It is another object of the present invention to provide smaller pallets which may be connected together into standard size pallets without the use of tools.

It is an additional object of the present invention to provide a pallet of dimensions one quarter a standard pallet, which can be combined into a half-size or full size pallet with other identical pallets.

It is also an object of the present invention to provide a modular pallet which may be brought together with an adapter to allow use of the combined assembly with conventional racks and conveyors, and to permit stacking.

Further objects, features and advantages of the invention will be apparent from the following detailed description when taken in conjunction with the accompanying drawings.

DESCRIPTION OF THE PREFERRED EMBODIMENTS

Figure 1:
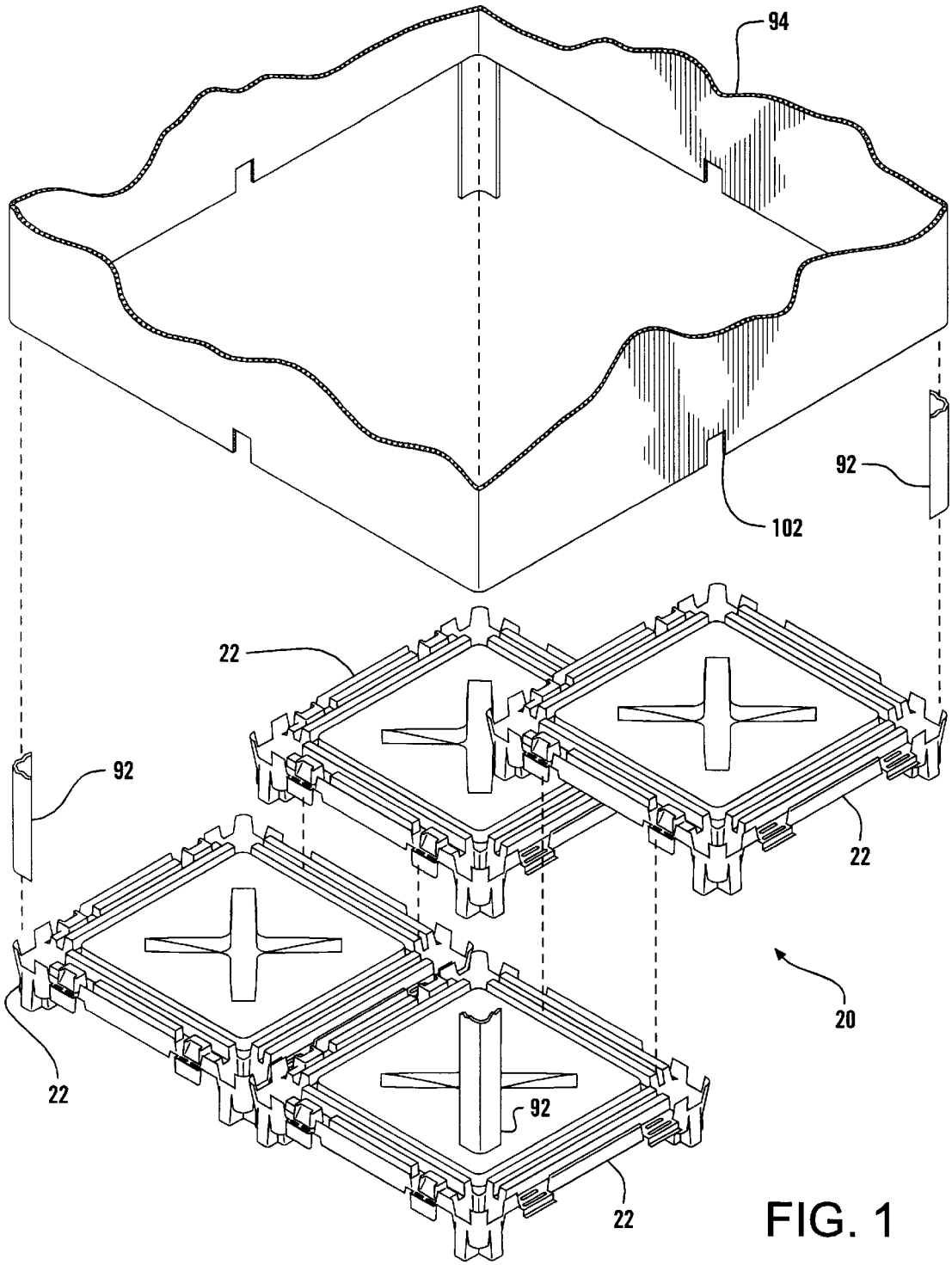
FIG. 1 is an exploded isometric view of the pallet system of this invention having four pallets, load corners, and a pallet sleeve.

Referring more particularly to FIGS. 1–8, wherein like numbers refer to similar parts, a pallet system 20 composed of a plurality of joined pallets 22 is shown in FIG. 1. Each pallet 22 is of a size which is a regular fraction of a standard pallet size. For example, a standard 40 inch by 48 inch pallet may be assembled from four 20 inch by 24 inch pallets 22. However, each pallet 22 is fully capable of standing alone as a freestanding, load supporting pallet.

Figure 4:
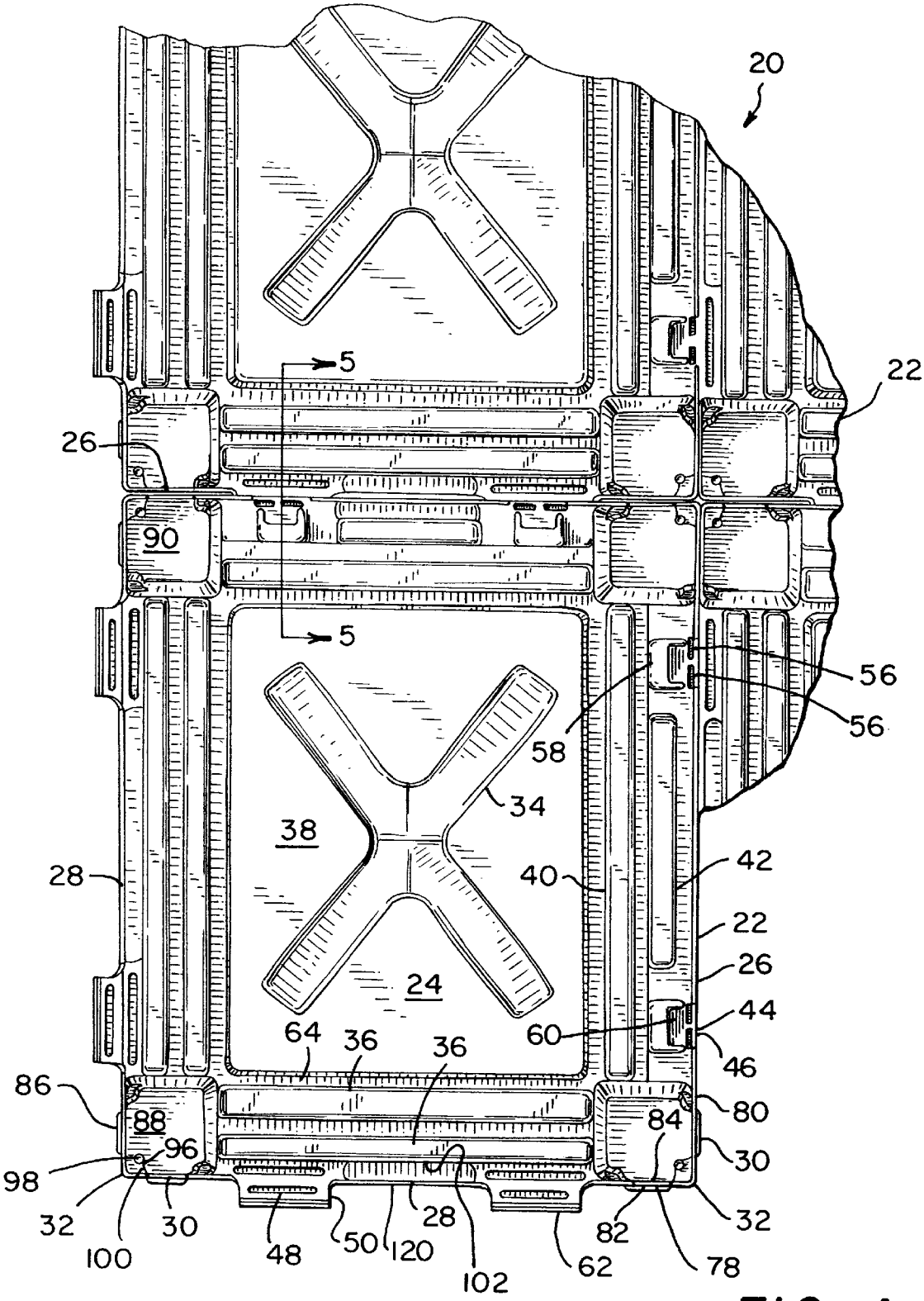
FIG. 4 is a fragmentary top plan view of the pallet system of FIG. 1.

As shown in FIG. 4, each pallet 22 has a rectangular horizontal deck 24 which engages and supports a load thereon. The deck has two adjacent first sides 26, extending at a right angle to one another, and two adjacent second sides 28 which also extend at right angles to one another, with each first side 26 being parallel to one of the second sides, and perpendicular to the other of the second sides. Four identical pallet legs 30 are positioned at the corners 32 of the pallets 22. The illustrated pallet 22 is formed in the single sheet thermoforming process from a sheet of thermoplastic material on a male mold. However, it should be noted that the pallet may be formed through other conventional plastic fabricating techniques, such as compression molding, twin sheet thermoforming, injection molding, or structural foam. In the single sheet thermoformed part, the center of the deck 24 is reinforced with a rigidifying structure 34, such as the x-shape shown. Two parallel ribs 36 are formed adjacent the center segment 38 of the deck 24 on each of the second sides 28. On the first sides 26, a first uninterrupted rib 40 extends adjacent the center segment of the deck 24, while a three-part rib 42, is positioned outwardly and parallel to the first rib 40.

Figure 2:
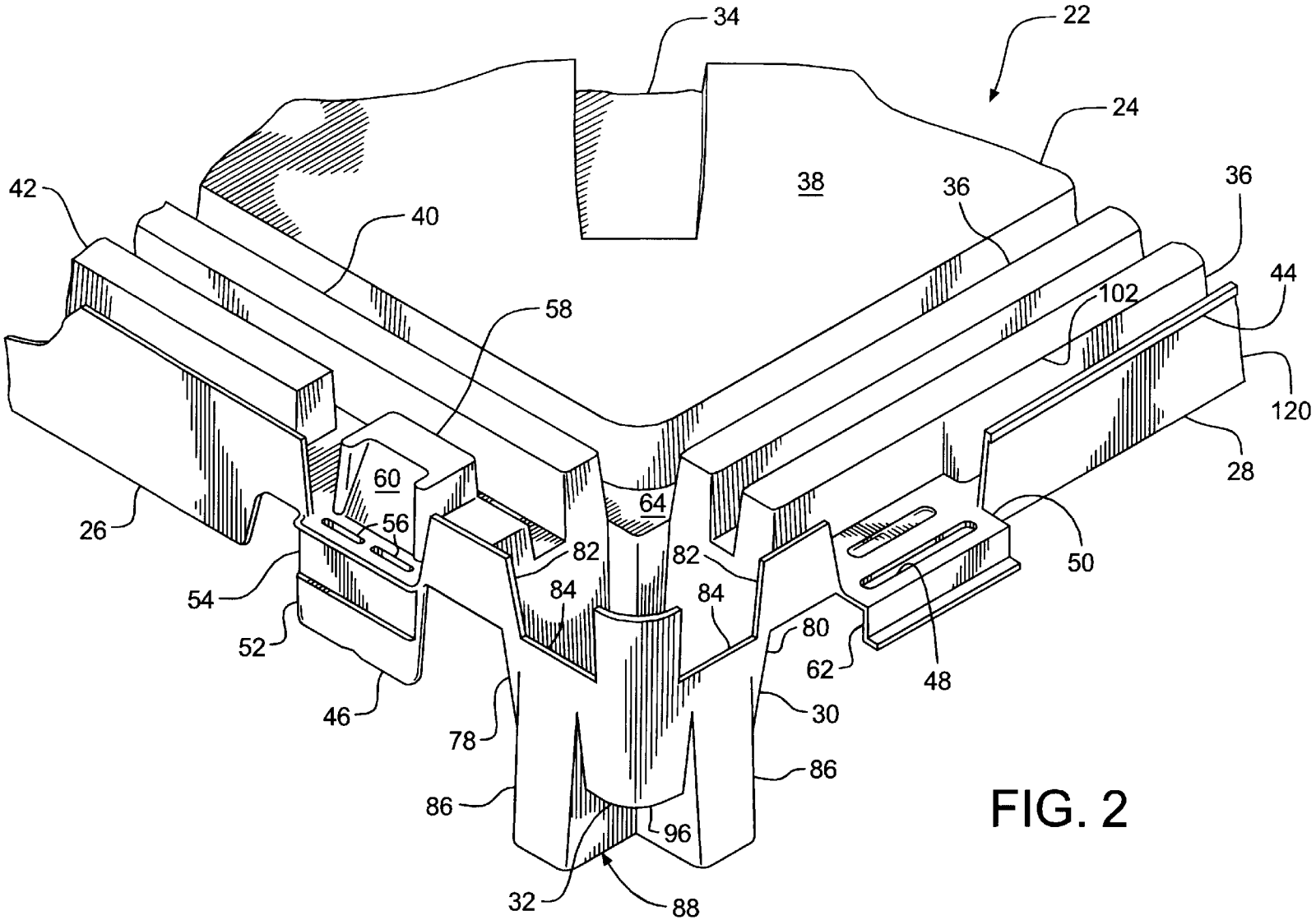
FIG. 2 is a fragmentary isometric view of the interior of a leg of the pallet of FIG. 1.
Figure 5:
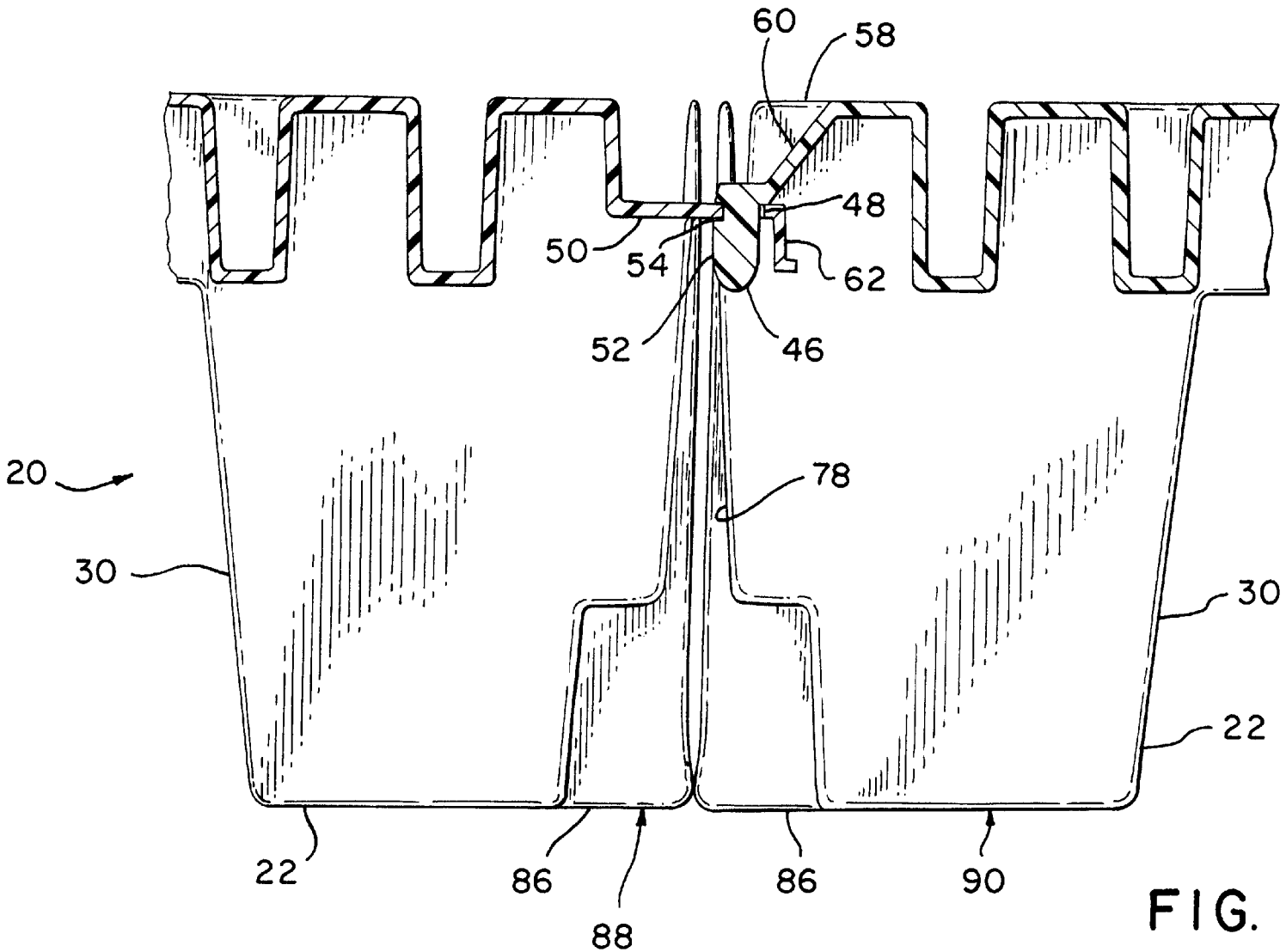
FIG. 5 is a fragmentary cross-sectional view of the joined pallets of FIG. 4.

The pallet 22 is releasably connected to another identical pallet 22 by structure positioned along the deck perimeter 44. Each first side 26 has two downwardly protruding tabs 46 which engage with slots 48 formed in outwardly protruding ears 50 which extend from the pallets second sides 28. As shown in FIG. 2, each tab 46 has a downwardly extending outwardly facing surface 52. A groove 54 is formed in the outwardly facing surface 52, for example by routing. As shown in FIG. 5, the tab 46 is narrowest where the groove 54 has been formed. The slot 48 in the protruding ear 50 is cut so that the narrow dimension of the slot is approximately the thickness of the tab 46 at the location of the groove 54. Hence, when a loaded pallet 22 is positioned alongside another pallet and lowered on a forklift tine such that the tabs of the first pallet overlie the slots of the second pallet, the tabs will protrude into the slots 48, and, once engaged, will connect the two pallets in an interference fit.

The tabs 46 may be formed in various fashions depending upon the plastic forming process employed. However, in a single sheet thermoforming process, the tab 46 may be formed over two protruding segments of the thermoforming mold which form two side by side pockets 56, shown in FIG. 2, which causes the plastic to fuse sidewardly. The region adjacent the tab 46 is stiffened by an upwardly protruding cap 58, which has a downwardly extending ramp 60 adjacent the pockets 56, to reduce the draw into the pockets. The ears 50 protrude outwardly from the second sides 28 and have a downwardly protruding flange 62 which contributes to the stiffness of the ear and the slot opening.

As shown in FIG. 5, a valley 64 is defined between the deck center segment 38 and the ribs 36 or 40. The depth of the valley 64 defines the thickness of the deck 24. It will be noted that the ears 50 extend at a position which is spaced halfway between the uppernost surface of the deck and the lowermost surface of the valley 64.

Figure 6:
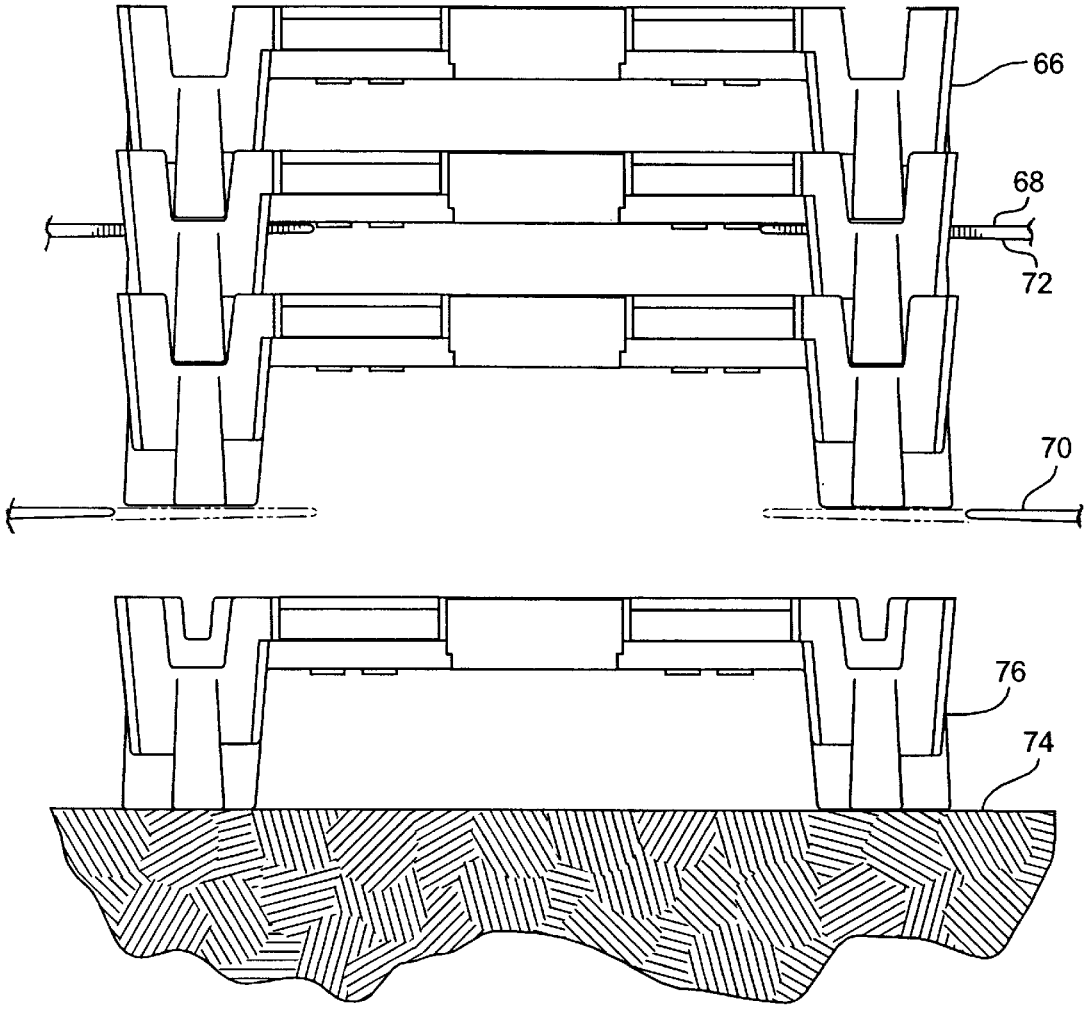
FIG. 6 is a side elevational view of a plurality of pallets, with an individual pallet being dispensed onto a supporting surface.

As shown in FIG. 6, the pallets 22 are adapted for automated dispensing from a stack 66. The automated pallet dispenser 68 has two sets of retractable tines, a lower set 70 which engages the lowermost pallet 22 which is about to be dispensed, and an upper set 72 of tines which engages the remainder of the stack 66. In operation, both sets 70, 72 of tines are inserted beneath the decks 24 of the lowermost pallet and the pallet directly above. The lower set 70 of tines is spaced above a support surface 74 which may be a floor or a moving conveyor belt. The lower set 70 is spaced from the support surface 74 a distance slightly greater than the height of a pallet 22. When the lower set of tines 70 are retracted, the lowermost pallet is no longer supported and it falls to the underlying support surface 74. The dispensed pallet 76 may then be removed by a forklift truck, or carried away on a conveyor belt for loading. After the pallet 76 has been dispensed, the lower set of tines 70 are inserted, and the upper set 72 of tines is retracted, allowing the entire stack 66 to descend onto the lower set of tines 70. In this way the entire stack of pallets 22 may be dispensed until it is time to replenish the stack.

Because of the automated nature of the machine dispensing of the pallets, it is important that each pallet be spaced a uniform distance from the overlying pallets within a stack, and that nested pallets do not wedge themselves together. To ensure these properties in the pallets 22, the legs 30 are formed with negative draft structure, as shown in FIG. 2 and FIG. 5.

Figure 3:
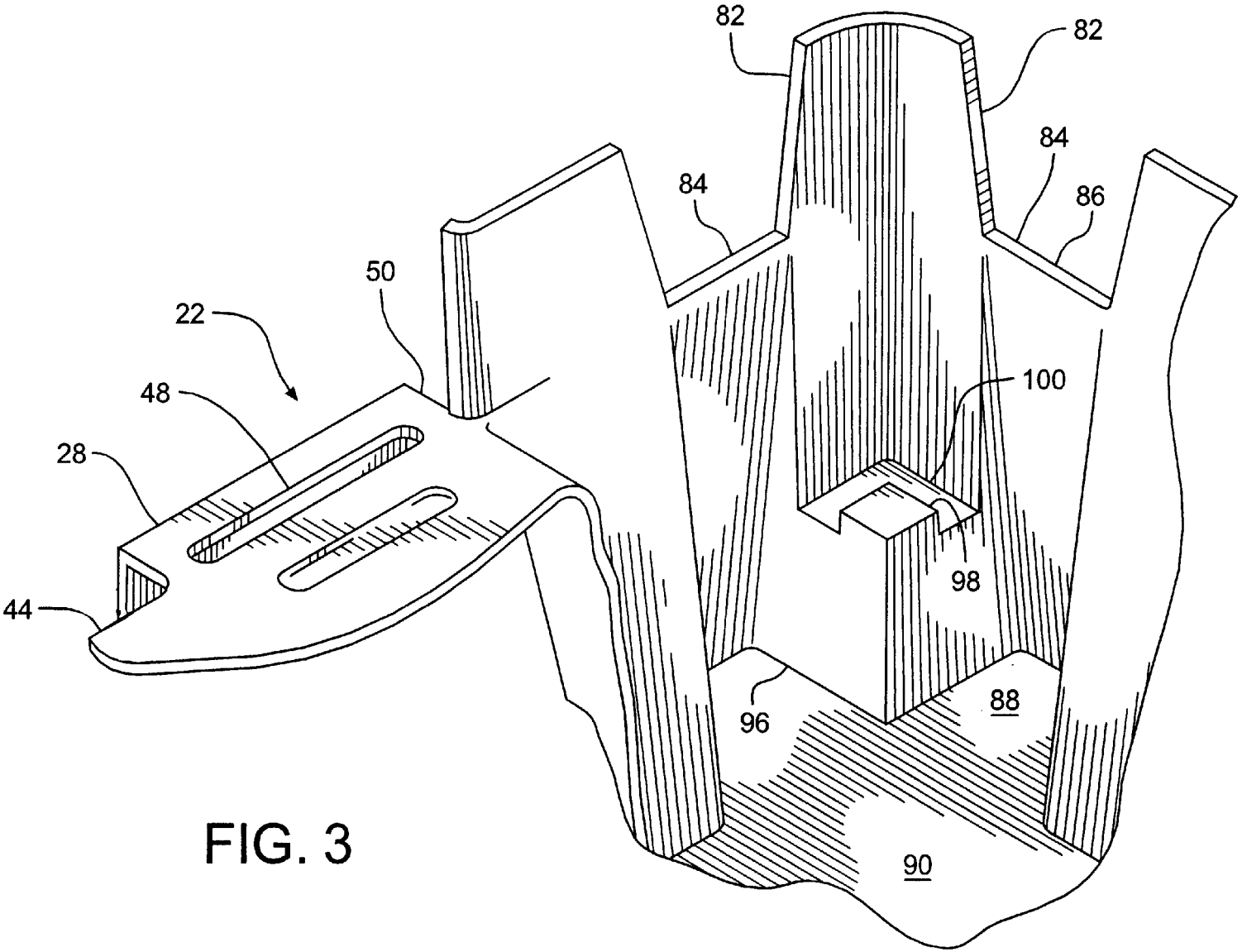
FIG. 3 is a fragmentary isometric view of the exterior of a leg of a pallet of FIG. 1.

As shown in FIG. 3, each leg 30 has a first side wall 78 which extends at a right angle to a second side wall 80 on the exterior of the pallet 22. Each side wall 78, 80, has an upwardly opening channel 82. The channels 82 have a lower surface 84 which defines the upper limit of a leg segment 86. The lower surface 84 is positioned at approximately the level of the underside of the deck, as shown in FIG. 6. The leg segment 86 extends downwardly and outwardly from the lower surface 84 of the channel 82, and terminates in an inwardly extending lower floor segment 88. The lower floor segment 88, because it protrudes from the channel 82, will extend across the channel lower surface 84 of an underlying pallet 22. Furthermore, the two channels 82 in the perpendicular sidewalls 78, 80 serve to locate the two overlying pallets 22 with respect to one another. Furthermore, the lower surfaces 84 of the channels 82 positively limit the extent to which overlying pallets may nest. The two lower floor segments 88 form parts of the leg floor 90, as shown in FIGS. 3 and 4.

As shown in FIG. 1, the pallets 22 are provided with structure which permits them to readily receive reinforcing corner stiffeners 92 or a protective pallet sleeve 94. In forming a palletized load, it is common to place the supported articles on the pallet deck 24, position right angle paperboard or plastic stiffeners 92 at the corners, and then shrinkwrap the entire pallet, stiffeners, and product assembly. Each leg 30 of the pallet 22 has a step 96, best shown in FIG. 3, located between the first side wall and the second side wall 78, 80 at the leg exterior. The step 96 has an upwardly extending projection 98 which defines a right angle groove 100 with the leg walls 78, 80 to receive and position a stiffener 92. In situations in which each pallet will be loaded with goods for later breaking down into separate groups, each pallet may be individually shrink-wrapped before being connected together to adjoining pallets. In such a situation, stiffeners may be provided in each pallet leg.

A pallet sleeve groove 102 is defined between the exterior rib 36 and exterior upstanding flange 120. Downwardly opening slots 122 may be cut in the sleeve where it bridges two connected pallets 22. This groove 102 is positioned to be aligned with the channels 82 in the legs, such that the sleeve will extend across the two connected legs where two pallets 22 are joined. The sleeve may constitute a point of purchase merchandise display in the retail environment.

The pallet system 20, comprised of several connected pallets 22 and related corner stiffeners or sleeve, may then be transported and stored as needed as a single unit. At the point at which the loads are to be broken down, the overall shrinkwrapping may be removed, leaving individual loads on the still connected pallets 22. The tabs which extend into the slots of adjoining pallets 22 securely connect the pallets without the need for additional fasteners or connectors. However, the individual pallets are readily separated by inserting the tines of a forklift truck beneath only that pallet or pallets which is to be separated, and lifting upwardly. The weight of the non engaged pallets 22 is sufficient to overcome the interference fit between the pallets, allowing them to be readily separated. The spacing of the four pallet legs 30 is such as to permit a single tine of a forklift truck to be received between the legs. Because conventional forklift truck tines are fairly wide with respect to the dimensions of the pallet 22, it is possible to support a load on a single tine. Moreover, the individual pallets 22 may be engaged and supported on properly configured hand trucks.

Figure 7:
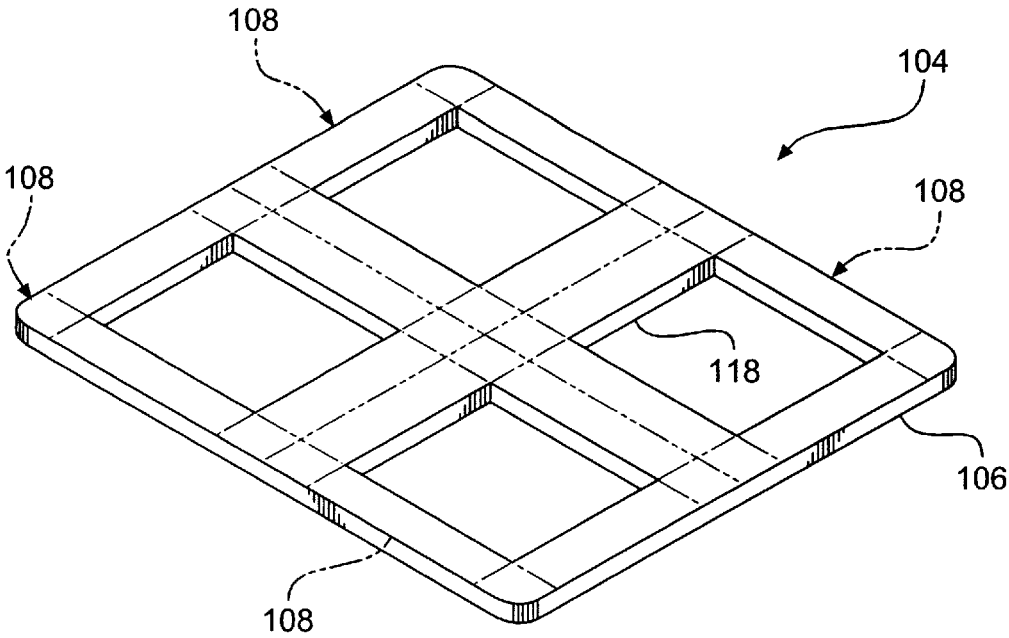
FIG. 7 is a schematic isometric view of an alternative embodiment pallet system of this invention, having an adapter connected to four quadrant pallets to permit the combined pallets to better withstand the requirements of being racked, stacked or conveyed.
Figure 8:
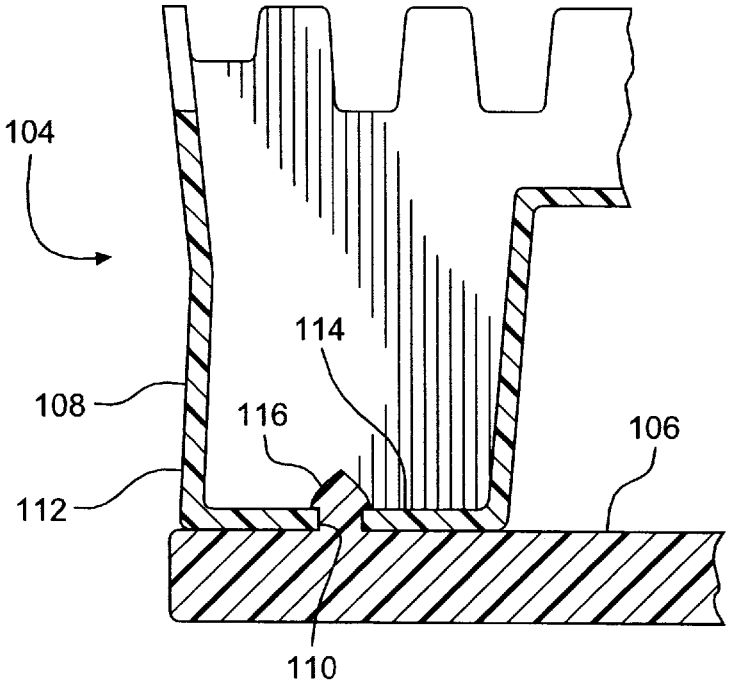
FIG. 8 is a fragmentary cross-sectional view of one leg of a pallet of FIG. 7 being connected to the adapter.

As shown in FIGS. 7–8, an alternative embodiment pallet system 104 provides a stiff unitary adapter 106 which engages beneath four connected pallets 108, similar to the pallets 22 discussed above, but having holes 110 in the leg 112 floors 114 which engage with barbs or protrusions 116 extending upwardly from the adapter 106. The adapter has the dimensions of a standard size pallet, and has a smooth undersurface which makes it suitable for transport on conventional conveyor systems. Furthermore, the adapter 106 is preferably sufficiently stiff to allow the combination of four pallets 108 and their loads to be supported on conventional rack systems designed for wood pallets. In addition, the adapter 106 provides additional linkage between the connected pallets 108 to facilitate stacking of multiple loaded pallet assemblies. The adapter may have interior cutouts 118 to permit the pallet system 104 to be conveyed on a conventional hand truck. The adapter 106 may be constructed of vessel, plastic composites or a combination of these materials.

It should be noted that although a single sheet thermoformed structure has been described above, alternative structures fabricated through different plastic processes may be employed. For example, alternative structures for insuring the limited nesting of the pallets may be formed in molding processes such as compression molding, which do not require that part walls being of generally constant thickness. For example, the side walls of each leg may be provided with interior ledges at a specified height to prevent over nesting of the stacked pallets. Or, the lower level of the pallet legs may be filled with webbing or cross stiffeners which serve to prevent over nesting. In addition, the tab structure may be formed in many different fashions to provide the interference fit with the slot on an adjoining pallet. For example, in a compression molded part, the pallet tabs could be provided with a barb at its lowest extend, which protrudes sidewardly beneath the slot when engaged with the slot.

It is understood that the invention is not limited to the particular construction and arrangement of parts herein illustrated and described, but embraces such modified forms thereof as come within the scope of the following claims.

What is claimed is:

1. A pallet system comprised of a plurality of pallets, each pallet comprising:

an upwardly facing deck defining an exterior perimeter of the pallet, the deck being rectangular and having two adjacent first sides, and two adjacent second sides which are perpendicular to the first sides, wherein the deck has four corners;

a leg which extends downwardly from each deck corner, wherein each leg has an upwardly extending side wall, with portions of said leg side wall defining an upwardly opening channel, and portions of each leg positioned below the leg channel to extend generally perpendicular to and inwardly from said side wall to engage the channel of an underlying like pallet and restrict over nesting of two stacked pallets;

at least one tab which extends downwardly from each first side of the deck;

at least one ear which extends outwardly from each second side of the deck, wherein portions of the ear define a slot which is dimensioned to receive a tab in an interference fit, such that said plurality of pallets are combinable into a single larger pallet.

2. The pallet system of claim 1 wherein each pallet leg has a first side wall which is approximately perpendicular to a second side wall, and wherein the first side wall has a first upwardly opening channel, and the second side wall has a second upwardly opening channel, and wherein portions of the first side wall extend downwardly and outwardly from the first channel to define a first leg segment which terminates in a lower floor segment, and wherein portions of the second side wall extend downwardly and outwardly from the second channel to define a second leg segment which terminates in a lower floor segment, such that when a first pallet is supported on a second pallet the floor segments overlie the first channel and the second channel.

3. The pallet system of claim 1 further comprising a rigid adapter positioned beneath the plurality of pallets, and extending between all said plurality of pallets to support them.

4. The pallet system of claim 3 further comprising portions of the adapter which extend into engagement with the plurality of pallets in a snap fit.

5. A machine dispensable pallet comprising:

a rectangular deck having an upper surface and four corners;

four legs extending downwardly from the rectangular deck, each leg positioned at one of said corners, wherein each leg has two outwardly facing leg side walls, and wherein at least one of the leg side walls has portions which project outwardly as the portions extend downwardly from the deck, wherein said at least one leg side wall has portions defining an upwardly opening channel which extends from an uppermost portion of said at least one leg side wall downwardly toward said projecting portions, said channel being aligned above said projecting portions and sized to receive and support the projecting portions from a second like pallet.

6. The pallet of claim 5 wherein the pallet deck defines an exterior perimeter of the pallet, the rectangular deck having two adjacent first sides, each first side having at least one tab which extends downwardly from each first side; and each second side having at least one ear which extends outwardly from each second side of the deck, wherein portions of the ear define a slot which is dimensioned to receive a tab similar in dimension to the at least one tab in an interference fit.

7. The pallet of claim 5 further comprising a plurality of substantially identical pallets stacked one upon another.

8. The pallet of claim 5 further comprising three substantially identical pallets abutted together to form a single larger rectangular pallet co-joined with the pallet to form the single larger pallet by mechanical interlocks between abutting pallets.

9. A pallet assembly comprising:

two identical pallets removably connected together, wherein each pallet comprises:

a rectangular deck having an upper surface and four corners;

four legs extending downwardly from the rectangular deck, each leg positioned at one of said corners, openings being defined between each pair of two legs;

a plurality of tabs which are positioned above the openings on a first side of the pallet, and which extend downwardly;

a plurality of slots positioned above the openings on a second side of the pallet, wherein the two identical pallets are securely connected by engagement of the tabs on one pallet extending downwardly into the slots of the other pallet, the individual pallets being readily separated by inserting the tines of a forklift truck beneath only that pallet which is to be separated, and lifting upwardly, the weight of the non engaged pallets being sufficient to overcome the fit between the pallets, allowing them to be readily separated.

10. A pallet assembly comprising:

a first pallet, a second pallet, a third pallet, and a fourth pallet, wherein each pallet has a deck and legs which extend downwardly from the deck, each pallet having portions which extend sidewardly to mechanically engage with an adjoining pallet, and wherein portions of each pallet leg define a downwardly opening hole; and a stiff unitary adapter positioned beneath the pallets, the rigid adapter having a plurality of upwardly extending barbs, one of said barbs extending into each of said pallet leg holes, to thereby engage the four pallets to the adapter in a snap fit.

11. The pallet assembly of claim 10 wherein portions of the adapter define a plurality of interior cutouts to permit the pallet assembly to be conveyed on a convention hand truck.

* * * * *